US007856698B2

(12) United States Patent
Hays

(10) Patent No.: US 7,856,698 B2
(45) Date of Patent: Dec. 28, 2010

(54) FASTENER DEVICE

(76) Inventor: Barrett Hays, 723 Mesa Ridge, San Antonio, TX (US) 78258

( * ) Notice: Subject to any disclaimer, the term of this patent is extended or adjusted under 35 U.S.C. 154(b) by 637 days.

(21) Appl. No.: 11/827,089

(22) Filed: Jul. 10, 2007

(65) Prior Publication Data

US 2009/0013503 A1 Jan. 15, 2009

(51) Int. Cl.
*F16G 11/00* (2006.01)

(52) U.S. Cl. ..... 24/129 R; 24/129 A; 24/18; 24/370

(58) Field of Classification Search ..... None
See application file for complete search history.

(56) References Cited

U.S. PATENT DOCUMENTS

| | | | | |
|---|---|---|---|---|
| 2,974,383 | A | | 3/1961 | Bright |
| 3,048,906 | A | | 8/1962 | Patterson |
| 3,119,160 | A | | 1/1964 | Hoppeler |
| 3,509,581 | A | * | 5/1970 | Lewis ..... 2/240 |
| 3,721,750 | A | | 3/1973 | Countryman |
| 4,158,250 | A | | 6/1979 | Ringwald |
| 4,237,174 | A | | 12/1980 | Lagardere et al. |
| 4,422,217 | A | | 12/1983 | Barrette |
| 4,569,108 | A | | 2/1986 | Schwab |
| 4,910,835 | A | | 3/1990 | Carpenter |
| 5,008,983 | A | * | 4/1991 | Heins ..... 24/131 C |
| 5,081,746 | A | | 1/1992 | Czwartacki |
| 5,199,135 | A | | 4/1993 | Gold |
| 5,232,193 | A | | 8/1993 | Skakoon |
| 5,325,568 | A | | 7/1994 | Bruhm |
| 5,524,327 | A | | 6/1996 | Mickel et al. |
| 5,531,418 | A | | 7/1996 | Lindgren |
| 5,715,578 | A | | 2/1998 | Knudson |
| 5,852,851 | A | | 12/1998 | Cooper |
| 5,987,707 | A | | 11/1999 | DeShon |
| 5,996,204 | A | | 12/1999 | Norwood |
| 6,195,846 | B1 | | 3/2001 | Studdiford et al. |
| 6,226,839 | B1 | | 5/2001 | Sayegh |
| 6,543,094 | B2 | | 4/2003 | D'Addario |
| 6,793,595 | B1 | | 9/2004 | Monnet |
| 6,842,948 | B2 | | 1/2005 | Smith |
| 6,973,700 | B2 | | 12/2005 | Hsiao |

* cited by examiner

*Primary Examiner*—Jack W. Lavinder
(74) *Attorney, Agent, or Firm*—Kammer Browning PLLC

(57) ABSTRACT

An easy to use, inexpensive fastener device that is generally shaped like the letter "H," or similar cross-connected structure, which is used for bundling multiple items in conjunction with a closed loop band. The multi-purpose fastening device has a simple structural design such that a continuous length of cord or elastic may be looped around one of the uprights of the "H," wrapped around a bundle of items, and then looped around the other upright of the "H," thus holding the items together. The clip may be constructed of plastic, metal, or other rigid material and may be of varying size, thickness, and tensile strength, depending on the weight to be supported.

6 Claims, 4 Drawing Sheets

FASTENER DEVICE

BACKGROUND OF THE INVENTION

1. Field of the Invention

The present invention relates generally to fastener devices used for bundling multiple items. More specifically, the present invention discloses a fastener device designed to engage the ends of a closed loop band for bundling multiple items together.

2. Description of the Related Art

Well known in the prior art are fastening devices utilized to hold a cord, cable, or strap securely in place. These various devices include two-piece bundlers which utilize a closed-loop band or hitch pin and two-piece bundlers which utilize an open-loop strap or buckle block. There are also a variety of closers, clasps, clamps, and hooks. The various two-piece bundlers include various types of bands wherein a band is wrapped around a bundle and through itself with a pin or notched dowel holding the ends of the band. These devices have a protruding rod or pin that can slip out of the band or that interferes with placement of other objects on top of the bundle. The devices having a notched dowel are intended for use with a specific size band which can be slipped through the notch and thus do not typically accommodate bands of varying sizes. Many of the other fastener devices that are used are complex in design and of limited functionality.

Thus, there is a need for an inexpensive, versatile, easy to use fastener which can securely hold together items of varying shape and weight. Such a device would ideally be simple to use and simple in design, without movable parts to break, thus eliminating the need for repairs and replacement. The device should be inexpensive to manufacture and easily replaceable. In comparison to the cumbersome design and limited versatility of some fasteners known in the art, such a device would allow similarly bound bundles to be stacked on top of one another without a dowel or fastener getting in the way. The user should be able to select the number and size of fasteners necessary for the specific use. Each fastener should be able to be removed separately to facilitate replacement or reorganization of the individual items. Existing devices have been unable to provide all of these benefits.

SUMMARY OF THE INVENTION

The present invention provides a fastener that is generally shaped like the letter "H," or a similar cross-connected structure, which is used primarily for bundling multiple items in conjunction with a closed loop band. More specifically, the present invention is a multi-purpose fastening device having a simple structural design such that a continuous length of cord or elastic may be looped around one of the uprights of the "H," wrapped around a bundle of items, and then looped around the other upright of the "H," thus holding the items together. The clip may be constructed of plastic or other rigid material and may be of varying size, thickness, and tensile strength, depending on the weight to be supported.

Single or multiple fasteners may be utilized, depending on the shape and weight of the items to be bundled. The user can select the number and size of fasteners as needed for the specific use. Additionally, each fastener can be removed separately to facilitate replacement or reorganization of the individual items.

A first preferred embodiment of the fastener is shaped like the letter "H" with two end pieces connected by a single crossbar. Alternatively, the device may have two bent end pieces connected by a single crossbar. In a further embodiment of either the regular "H" shaped device or the bent end piece device, a small raised cylindrical post is fixedly attached to each appendage of the device in order to further secure the band around the cross bar and prevent slippage off the end pieces. All of these options for fastening a the tensile strength of the material of which it is constructed. The dimensions of the device of the present invention are scaled to match the dimensions of the items to be bundled. That is, the device may be provided in a number of different standard sizes. This simple sleek design requires minimal machining, thus allowing easy bulk bundle of items are designed to facilitate easy and versatility of use.

The fastener is proportioned to fit snugly against the bundled items and to permit other items to lay flat on top of the bundle. The strength of the fastener is variable according to manufacturing with low production costs and a consequently lower purchase price for consumers. The device is easily used and transported and can be inexpensively replaced if worn, damaged, or lost.

BRIEF DESCRIPTION OF THE DRAWINGS

A more complete understanding of the present invention may be had by reference to the following detailed description taken in conjunction with the accompanying drawings, wherein.

DETAILED DESCRIPTION OF THE PREFERRED EMBODIMENTS

The present invention is related to fasteners for holding together a bundle of items with a closed-loop band. The fastener is generally shaped like the letter "H." More specifically, the invention is a multi-purpose fastening device having a simple structural design such that a continuous length of cord or elastic may be looped around both ends of one of the uprights of the "H," wrapped around a bundle of items, and then looped around both ends of the other upright of the "H," thus holding the items together.

Figure 1A:
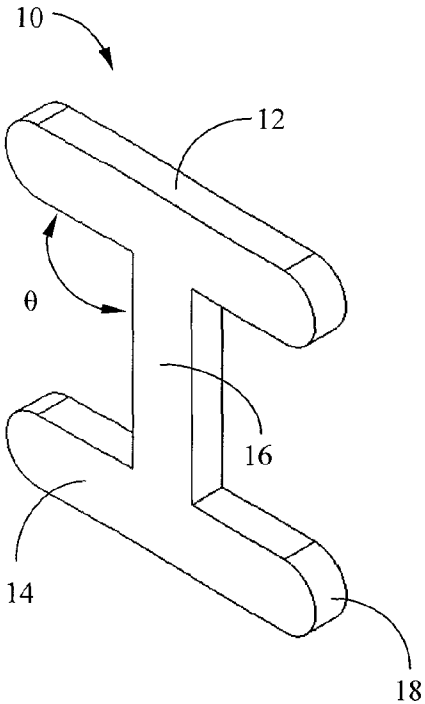
FIG. 1A shows a perspective view of a first embodiment of the fastener of the present invention having straight end pieces.
Figure 1B:
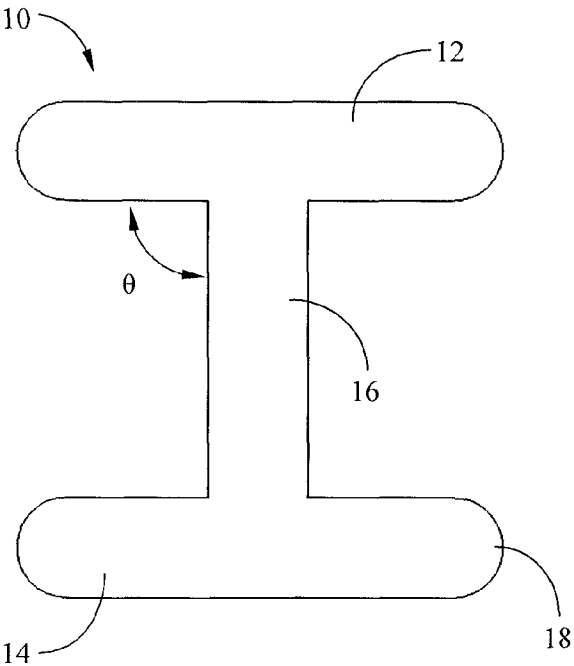
FIG. 1B shows a top elevation view of a first embodiment of the fastener of the present invention having straight end pieces.
Figure 1C:
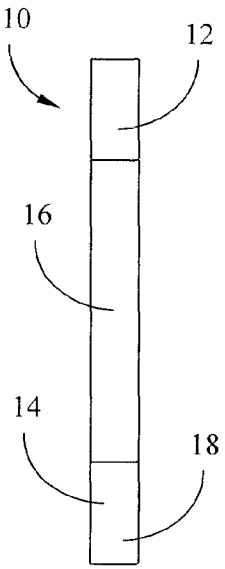
FIG. 1C shows a side elevation view of a first embodiment of the fastener of the present invention having straight end pieces.
Figure 1D:
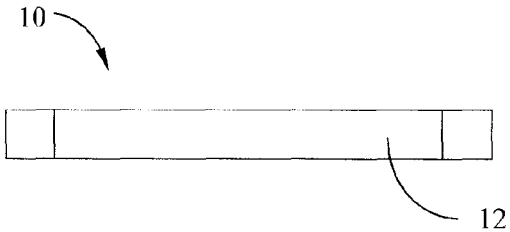
FIG. 1D shows an end elevation view of a first embodiment of the fastener of the present invention having straight end pieces.

As summarized above, FIG. 1A shows a perspective view of the fastener 10 of the present invention having straight end pieces. The first end piece 12 and second end piece 14 are connected by a crossbar 16. The corners 18 of the end pieces (12 and 14) are rounded to prevent the fastener from cutting the band or cord, the items to be bundled, and/or the user from being poked by the corners of the fastener. In this embodiment, each of the end pieces are joined to the crossbar at an angle θ such that a right angle (approximately) is formed, resulting in a fastener generally shaped like the letter "H." FIG. 1B is a top elevation view of the fastener having straight end pieces and demonstrating the simplicity of the fastener's design. FIGS. 1C and 1D show side and end elevation views, respectively, of the fastener having straight end pieces and illustrating the slim profile of the fastener.

Figure 2A:
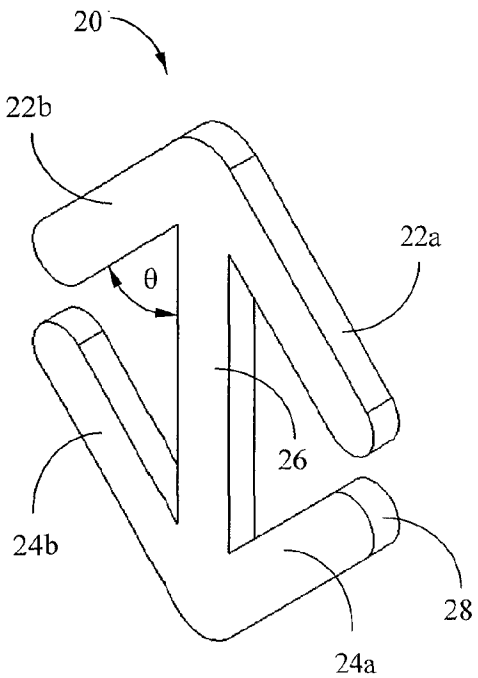
FIG. 2A shows a perspective view of an alternate embodiment of the fastener of the present invention having bent end pieces.
Figure 2B:
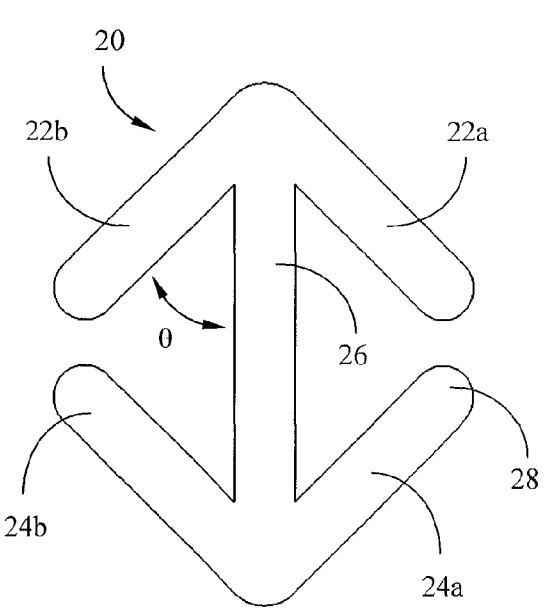
FIG. 2B shows a top elevation view of an alternate embodiment of the fastener of the present invention having bent end pieces.
Figure 2C:
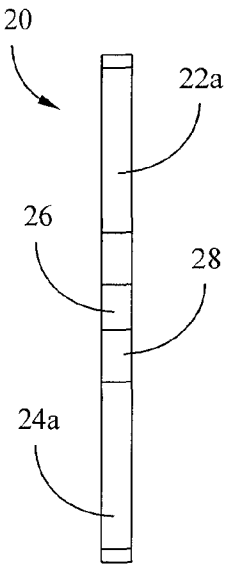
FIG. 2C shows a side elevation view of an alternate embodiment of the fastener of the present invention having bent end pieces.
Figure 2D:
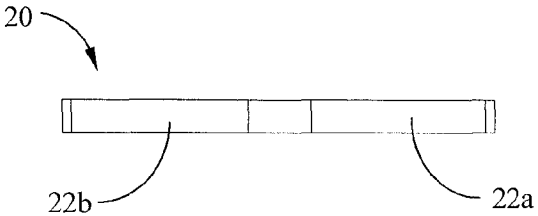
FIG. 2D shows an end elevation view of an alternate embodiment of the fastener of the present invention having bent end pieces.

FIGS. 2A, 2B, 2C, and 2D illustrate similar views of an alternate embodiment of the fastener of the present invention having bent end pieces. As shown in the perspective view of FIG. 2A, the fastener 20 has bent end pieces (22*a* and 22*b*, 24*a* and 24*b*). The bent end pieces are connected by a crossbar 26 at an acute angle θ such that the end pieces of the fastener are generally arrow-shaped rather than "H"-shaped. Once again, the corners 28 of the end pieces (22*a*, 22*b*, 24*a*, and 24*b*) are rounded for convenience and safety. FIG. 2B illustrates a top elevation of the fastener having bent end pieces and a generally double arrow-shaped design. This embodiment having bent end pieces may be particularly useful for holding heavy bundles or for securing a bundle using a band which is wide relative to the end pieces of the fastener. FIGS. 2C and 2D show side and end elevation views, respectively, of the fastener 20 having bent end pieces and demonstrating that the slim profile of the fastener is retained in this variation on the design.

Figure 3:
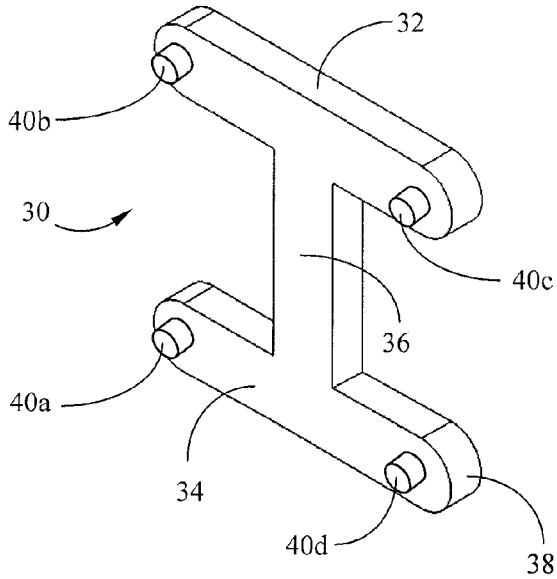
FIG. 3 shows a perspective view of the fastener of the present invention having straight end pieces with cylindrical end posts attached to each of the appendages of the fastener.

FIG. 3 illustrates an alternate embodiment of the fastener of the present invention. Specifically, FIG. 3 shows a perspective view of the fastener 30 having straight end pieces (32 and 34) with cylindrical end posts (40*a*, 40*b*, 40*c*, and 40*d*) attached to each of the appendages of the end pieces of the fastener. These cylindrical end posts are designed to further secure the bundle by providing a raised obstruction over which the ends of the band are placed. In order to remove the band in this embodiment, the ends of the band must be lifted over the cylindrical end posts. These cylindrical end posts may also be utilized with fastener 20 having bent end pieces, although they might not be as important for additional security for the bands.

Figure 4:
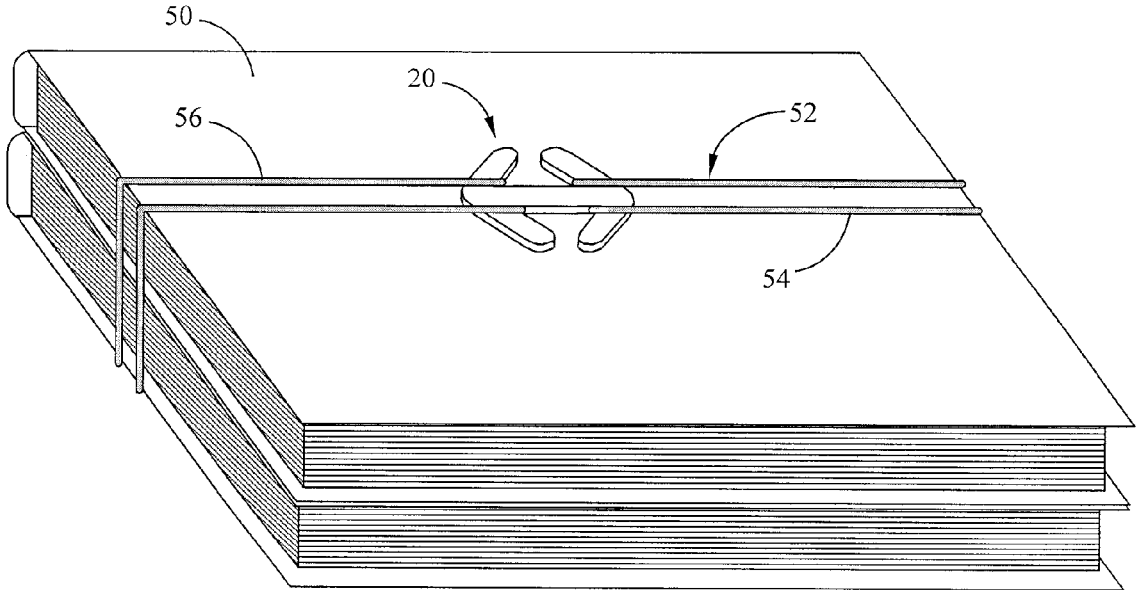
FIG. 4 shows a perspective view of the fastener of the present invention having bent end pieces secured around a bundle with a closed loop band.

FIG. 4 illustrates a perspective view of the fastener 20 of the present invention having bent end pieces in use secured around a bundle 50 with a closed loop band 52. As shown, the band is placed around the objects to be bundled. With the fastener positioned on top of the bundle, a first loop 54 of the band 52 is pulled over the corners of the first end piece of the fastener 20. While maintaining tension on the band, the second loop 56 of the band 54 is pulled over the corners of the second end piece of the fastener 20, thus securing the bundle. The band may be removed by pulling one of the loops over the corner of one end piece of the fastener and then the other end piece of the fastener. The band may be similarly reattached to the fastener.

Figure 5:
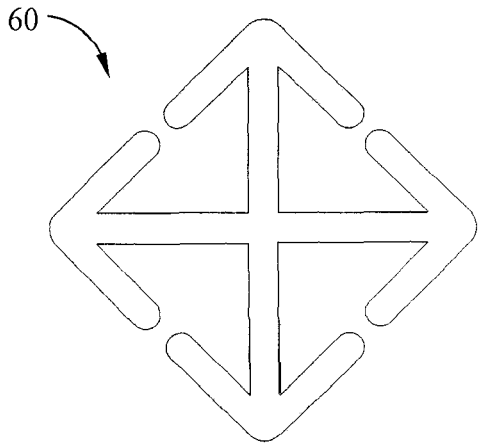
FIG. 5 shows a top elevation view of an alternate embodiment of the fastener of the present invention having two pair of bent end pieces.
Figure 6:
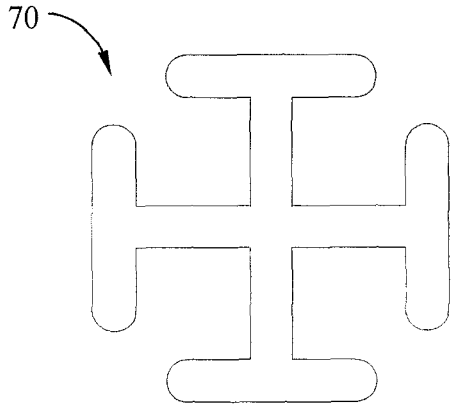
FIG. 6 shows a top elevation view of an alternate embodiment of the fastener of the present invention having two pair of straight end pieces.
Figure 7:
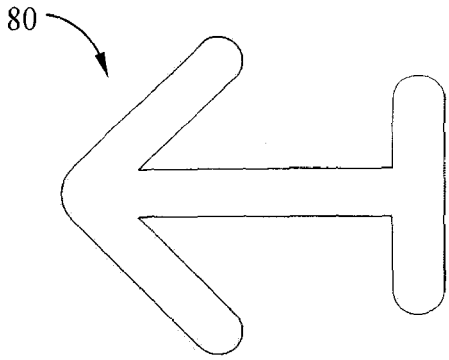
FIG. 7 shows a top elevation view of an alternate embodiment of the fastener of the present invention having one straight end piece and one bent end piece.
Figure 8:
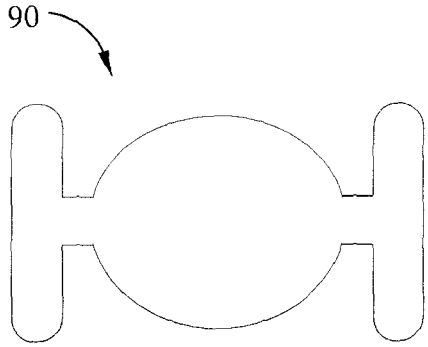
FIG. 8 shows a top elevation view of an alternate embodiment of the fastener of the present invention having a cross bar which is generally broad and flat.

FIGS. 5, 6, 7, and 8 illustrate alternate embodiments of the invention. In FIG. 5, the fastener 60 is shown having two pair of generally arrow-shaped end pieces. FIG. 6 shows the fastener 70 having two pair of generally straight end pieces. Both of these embodiments enable the user to fasten two bands around a bundle for additional security. FIG. 7 simply illustrates the fastener 80 having one straight and one generally arrow-shaped end piece. Finally, in FIG. 8, the fastener 90 is shown having a generally broad flat cross bar suitable for placement of a label, logo, brand name, or other advertising indicia.

The fasteners and bands may be linked together to accommodate larger bundles. The fasteners may be manufactured by molding or preferably by stamping methodologies well known in the art. The fasteners may be used with elastic or non-elastic bands but preferably elastic bands due to the prevalence of rubber bands and similar cords in the market. The fastener is preferably semi-rigid, such as hard but flexible plastic so as to bend slightly to accommodate the curve, if any, of the items to be bundled.

In general, the present invention provides an easy to use, inexpensive device for bundling objects with a closed loop band. It is anticipated that further variations in the structure of the device will be apparent to those skilled in the art from the present disclosure and the attached drawing figures. Such variations, while not explicitly described and defined herein, may be seen to fall within the spirit and scope of the present invention.

I claim:

1. A device for facilitating the bundling of one or more objects in conjunction with a closed loop band or cord, the device comprising:

a first end element for retention of a first loop end of the closed loop band or cord;

a second end element for retention of a second loop end of the closed loop band;

a cross bar extending between and connecting the first and second end elements;

means for securing the closed loop band or cord so as to ensure its retention around the end elements, the means for securing comprising a cylindrical post fixedly attached to each end of the first and second end elements; and wherein an angle of 90 degrees or less is formed at each angle of connection between the end elements and the cross bar.

2. The apparatus of claim 1 wherein the first and second end elements are straight and further wherein each angle of connection to the cross bar is approximately 90 degrees.

3. The apparatus of claim 1 wherein the first and second end elements are bent and further wherein each angle of connection to the cross bar is less than 90 degrees.

4. The apparatus of claim 1 wherein the device comprises a high density molded plastic material.

5. The apparatus of claim 1 wherein the device comprises a die-cut metal material.

6. The apparatus of claim 1 wherein the cross bar is generally broad and flat for placement of indicia.

* * * * *